US007213375B2

(12) United States Patent
Morgan et al.

(10) Patent No.: US 7,213,375 B2
(45) Date of Patent: May 8, 2007

(54) SEALED GLAZING UNITS

(75) Inventors: Timothy John Morgan, Manchester (GB); Eric Rowland, Ormskirk (GB); William Henry Brunt, Manchester (GB)

(73) Assignee: Pilkington PLC, St. Helens (GB)

( * ) Notice: Subject to any disclaimer, the term of this patent is extended or adjusted under 35 U.S.C. 154(b) by 0 days.

(21) Appl. No.: 10/466,201

(22) PCT Filed: Jan. 18, 2002

(86) PCT No.: PCT/GB02/00204

§ 371 (c)(1),
(2), (4) Date: Jul. 10, 2003

(87) PCT Pub. No.: WO02/057558

PCT Pub. Date: Jul. 25, 2002

(65) Prior Publication Data

US 2004/0068943 A1 Apr. 15, 2004

(30) Foreign Application Priority Data

Jan. 18, 2001 (GB) ..... 0101280.6

(51) Int. Cl.
*E06B 9/01* (2006.01)

(52) U.S. Cl. ..... 52/204.6; 52/204.593; 52/204.7; 52/786.1; 52/204.62

(58) Field of Classification Search ..... 52/204.593, 52/204.6, 204.62, 204.63, 204.7, 786.1, 786.11, 52/786.12, 786.13
See application file for complete search history.

(56) References Cited

U.S. PATENT DOCUMENTS

| | | | | | |
|---|---|---|---|---|---|
| 1,798,015 | A | * | 3/1931 | Dury | 52/204.593 |
| 2,406,939 | A | * | 9/1946 | Boicey | 52/204.62 |
| 3,910,254 | A | * | 10/1975 | Keimel et al. | 126/198 |
| 4,333,282 | A | * | 6/1982 | Medlin | 52/172 |
| 4,459,789 | A | * | 7/1984 | Ford | 52/656.5 |
| 4,680,206 | A | * | 7/1987 | Yoxon et al. | 428/34 |
| 4,942,711 | A | * | 7/1990 | Bergquist | 52/204.591 |
| 4,960,631 | A | * | 10/1990 | Walters et al. | 428/192 |
| 5,138,804 | A | * | 8/1992 | Roberts | 52/51 |
| 5,398,452 | A | * | 3/1995 | Schilde et al. | 49/501 |
| 5,540,514 | A | * | 7/1996 | Demars et al. | 403/388 |
| 5,636,484 | A | * | 6/1997 | DeBlock | 52/204.5 |
| 5,802,783 | A | * | 9/1998 | Bayha | 52/204.5 |
| 6,105,319 | A | * | 8/2000 | Brunt | 52/204.593 |

* cited by examiner

*Primary Examiner*—Basil Katcheves
(74) *Attorney, Agent, or Firm*—Marshall & Melhorn, LLC

(57) ABSTRACT

Sealed frameless multiple glazing units comprising at least three panes of glass wherein the air spaces within the unit are hermetically sealed one from the other are believed to be new. The units preferably comprise a fixing assembly wherein the boss is formed from two interlocking parts. The two part boss facilitates the assembly of the units and serves to support the weight of the unit.

22 Claims, 3 Drawing Sheets

SEALED GLAZING UNITS

BACKGROUND OF THE INVENTION

This invention relates to sealed glazing units spaced apart by a perimeter seal, to methods for the construction of such units and to fixing assemblies which are useful in these novel units and methods.

Suspended assemblies comprising a plurality of sealed double glazing units spaced apart by a perimeter seal (so-called frameless glazing units) mounted edge to edge so as to provide the appearance of a solid glass wall are increasingly used in buildings. GB 2171137 describes such assemblies comprising an array of double glazed units each of which comprises a fixing assembly which is attached to one of the panes in a manner which allows the unit to flex without impairing the seal of the unit.

The known frameless systems are all based upon double glazed units. As building regulations become more stringent the performance of these units especially their heat retention properties may be less than is required by regulation or desired by the architect. One method of improving the heat retention properties of conventional framed windows is to replace double glazed units with triple glazed units. However the design of a triple glazed frameless glazing unit is complicated by the need to support the additional weight of a third pane and by the need to ensure that the glazing does not fail under wind load.

SUMMARY OF THE INVENTION

We have now discovered that these problems may be overcome by attaching a fixing assembly so as to share the load between the inner and the outer pane and sealing the air spaces within the unit.

Thus from a first aspect this invention provides a sealed multiple glazing unit comprising at least three panes spaced apart from one another by a perimeter seal and having at least one fixing position within the perimeter seal at which fixing position there is a fixing assembly which is attached to the inner and the outer panes and which passes through a sealed hole in the centre pane.

The seal between the air spaces in the unit need not be completely airtight. However in the preferred embodiments that seal is a hermetic seal. Any passage of air between the two air spaces reduces the heat retention properties of the unit. Furthermore if the seal is airtight when the outer panes flex under wind load the air is compressed and transmit force to the inner panes causing them to flex and reducing the likelihood of two panes in the unit coming into contact.

The fixing assembly will preferably comprise a bush, a boss, a fixing member and a locking nut which engages the fixing member. A hole is drilled through each pane to define a fixing position. Such holes are normally circular and the boss is preferably of a generally cylindrical shape. The boss may be formed as a single component or from two components which interlock to form the boss.

Preferably the boss comprises two interlocking components having opposed faces which engage the faces of the centre pane thereby helping to retain that centre pane in position. A sealing ring formed from a suitable material such as nylon, neoprene rubber or a silicone rubber may be located on each of these opposed faces thereby sealing the centre pane.

Fixing assemblies wherein the boss comprises two interlocking pieces are believed to be novel and thus from another aspect this invention provides a fixing assembly for a sealed glazing unit comprising at least three panes said assembly comprising a boss, and a fixing member passing through said boss which is characterised in that the boss is formed from two interlocking components. In a preferred embodiment the boss is characterised in that the two interlocking components have opposed faces which are adapted to engage the surfaces of a glass pane when the components are interlocked.

Usually the sealed units are rectangular with a fixing position in the region of each corner. Preferably the fixing assembly is clamped to the innermost pane of the unit, more preferably it is also clamped to the outermost pane of the unit and most preferably it is also clamped to the centre pane. The holes in the innermost and in the outermost panes through which the fixing assembly passes must be hermetically sealed so as to preserve the integrity of the unit. The holes in the centre pane are preferably hermetically sealed so as to isolate the two air spaces within the unit from each other.

In those preferred embodiments where the fixing assembly is clamped to the panes of the unit, the unit may be sealed by providing a sealing ring on those surfaces of the assembly which are in contact with the pane. Conveniently this sealing ring may be an O ring located in an annular groove in that surface which protrudes slightly above that surface. The sealing ring may be formed from a variety of compressible materials such as nylon, silicone rubber or neoprene rubber. When the unit is assembled these rings are compressed and form a seal. In a more preferred embodiment this seal is supplemented by a secondary seal formed by filling the gaps between the contact surfaces of the assembly and the panes of the unit with a secondary silicone sealing compound.

A variety of fixing members have been used as part of the fixing assemblies used in existing frameless double glazing units. Any of these fixing members are potentially useful in the triple glazed units of this invention. The preferred classes of fixing member useful in the units of this invention include fixing bolts of the type described in UK patent GB 2171137 having a countersunk head which engages a countersunk hole in the outer surface of the outer pane. Also useful are fixing bolts of the type described in U.S. Pat. No. 4,793,112 having a countersunk head which engages a countersunk hole in the inner glass of a laminated outer pane. A third type of fixing member is described in European Patent EP 201212 comprising a ball member and a socket member wherein the socket is secured in a hole in the outer pane and the ball member is an elongate member which extends through the unit.

The fixing member is fixed to a supporting member which is attached to a building. Typically the supporting member may be a spring plate member. The provision of an array of supporting members on a building enables a corresponding array of glazing units to be mounted on that building usually in edge to edge relationship so as to provide the appearance of a solid glass wall. Assemblies comprising an array comprising the novel units provide a further aspect of the present invention.

The units of this invention preferably comprise three glass panes. Most commonly soda lime float glass having a thickness of from 2 to 20 mm and more preferably from 4 to 12 mm will be employed. Where the glass is load bearing toughened glass will preferably be used. In that instance the holes in the glass must be drilled prior to the toughening process. Glass panes having a low emissivity coating on at least one surface may also be utilised. Laminated glass may also be employed in particular as the outer pane. In a preferred embodiment the fixing assembly is located in the outer pane in a housing cut into the inner sheet of the laminate. The outer sheet of the laminate provides an uninterrupted surface when viewed from outside the building which may be aesthetically pleasing. The outer sheet of such a laminate may also be formed from decorated or patterned glass to provide a particular external appearance. Body tinted glasses may also be used to provide a unit having a particular appearance.

Panes formed from clear plastic materials such as polycarbonates may also be employed in the units of this invention. These plastic panes may replace some or all of the glass panes. In the preferred embodiments at least the outermost pane and more preferably both the innermost and the outermost panes are glass panes. Where a plastic pane is used it is preferably used to form the centre pane where the surface of the plastic is protected against scratching.

The thickness of the panes in each unit need not be identical. Each pane should be sufficiently thick and thereby sufficiently strong to withstand the load which is to be placed upon it. However the use of excessively thick panes is not desirable because of the consequent increase in the size and weight of the unit.

The heat retention properties of the units of this invention (expressed as a U value in units of $W/m^2K$) are preferably less than 3.0, more preferably less than 2.0 and most preferably less than 1.0. The U value of any unit is determined by a number of factors including the thickness of the panes, the distance between the panes and the presence of a heat reflecting coating on at least one surface of the glass and the position of that coating in the unit. Where a coated glass is used to improve the U value of the unit it is preferably located on surface 3 of the unit (that is on the outer surface of the centre pane using the conventional nomenclature numbering the outer surface of the outer pane as surface 1 and the inner surface of the outer pane as surface 2 etc.).

The units of this invention may be assembled by fitting a bush into a countersunk hole in the outer pane and locating the boss in the bush so that it is in contact with the interior surface of the outer pane. A spacer bar carrying a primary butyl sealant is then fitted around the perimeter of the pane. The centre pane is then fitted over the boss and presented so as to engage the spacer bar. The centre pane is held loosely in place by adhesion to the primary butyl sealant. A second spacer bar is then fitted around the perimeter of the centre pane and the inner pane is fitted over the boss and held loosely in place by adhesion to the primary butyl sealant. The entire unit can then be compressed to form the seals.

This assembly operation requires that the holes in the centre and inner panes be large enough to accommodate the boss. Since the diameter of the boss will be larger than the hole in the outer pane the boss may be tapered in order to permit the use of panes having holes with a smaller diameter which may be the same or a similar diameter to the hole in the outer pane. Such a boss comprises two portions one having a smaller diameter than the other. The hole in the centre pane is of a size as will fit over the smaller portion of the boss but not over the larger part. The centre pane is thereby located on the fixing assembly. The bottom portion of the boss may also be tapered in a similar fashion so that the inner pane fits over the tapered portion and is thereby located on the fixing assembly.

In the preferred embodiments of this invention the boss comprises two components which interlock to form the boss. These preferred units may be assembled using a variation of the above procedure which permits the use of panes having holes of an identical size and facilitates the sealing of the boss within the hole in the centre pane.

These two part bosses comprise two component parts each of which is in contact with the inner surface of either the outermost pane or the innermost pane and with the opposed surface of the centre pane. Preferably each part of the boss has an extension which passes through the hole in the centre pane said extensions interlocking one with the other to form the boss. The boss also preferably extends through the hole in the innermost pane but does not protrude beyond that pane.

The extensions which pass through the hole in the centre pane may conveniently take the form of hollow cylinders, the internal diameter of one being substantially the same as the external diameter of the other. The length of these extensions is such that they overlap each other and interlock with each other by virtue of the extension with the smaller external diameter forming a push fit with the extension having the larger external diameter.

The extension with the larger external diameter preferably has a diameter which is slightly less than the diameter of the hole in the centre pane. In the preferred embodiments the extension with the larger external diameter is part of that portion of the boss which is in contact with the inner surface of the outer pane of glass. Any part of the boss which extends through the hole in the inner pane preferably has a diameter which is slightly less than the diameter of the hole. In these preferred embodiments the slight differences between the diameters of the extensions and the diameters of the holes in the panes facilitates the assembly of the units. Further the space between the side of the extensions and the edge of the glass can be filled with a secondary silicone sealant which improves the seal between the boss and the centre glass.

In the preferred embodiments of the invention those surfaces of the boss which are in contact with the panes of the unit are provided with a secondary silicone sealant in addition to the primary sealing ring. The surface is provided with an annular groove in which the silicone may be located. Preferably the grooves are interconnected and are provided with an inlet passage through which silicone may be injected and an outlet passage through which air displaced by the sealant may escape. The inlet passage may connect to the interior passage of the boss so that (prior to the fixing member being inserted into that passage ) a suitable injector may be connected to the inlet passage and silicone injected through that passage. The passage through which the sealant may pass should be designed so as to avoid in so far as is possible the entrapment of air bubbles within the passage. Where the boss is formed from two interlocking components the components should be provided with locating means so as to fix their relative positions and ensure that the passage through which the sealant may be injected is not interrupted. The interlock between the two portions of the boss should be such that sealant does not enter the gap between the two portions.

These two component bosses also facilitate the assembly of the units using a novel method which is a variant upon the one described above. These methods comprise the steps of (a) fitting a bush into a countersunk hole in the outer pane; (b) locating a first component part of the boss in the bush so that it is in contact with the interior surface of the outer pane; (c) fitting a spacer bar around the perimeter of said outer pane; (d) fitting the centre pane onto the first component part of the bush; (e) locating the second component part of the boss so that it interlocks with the first component part of the bush; (f) fitting a spacer bar around the perimeter of said centre pane; (g) locating the inner pane so that it is in contact with the surface of the second component part of the boss and (h) compressing the unit. In a preferred embodiment the centre pane is located upon the extension of the first component part of the boss and the second component part of the boss is interlocked with the first part by engaging an extension thereof with that extension of the first part In the more preferred embodiments the method comprises an additional step (i) wherein a secondary silicone sealant is injected through an inlet passage into the spaces between the panes and the surfaces of the boss which are in contact with those panes. One embodiment of the invention will now be described with reference to the accompanying drawing.

Figure 1:
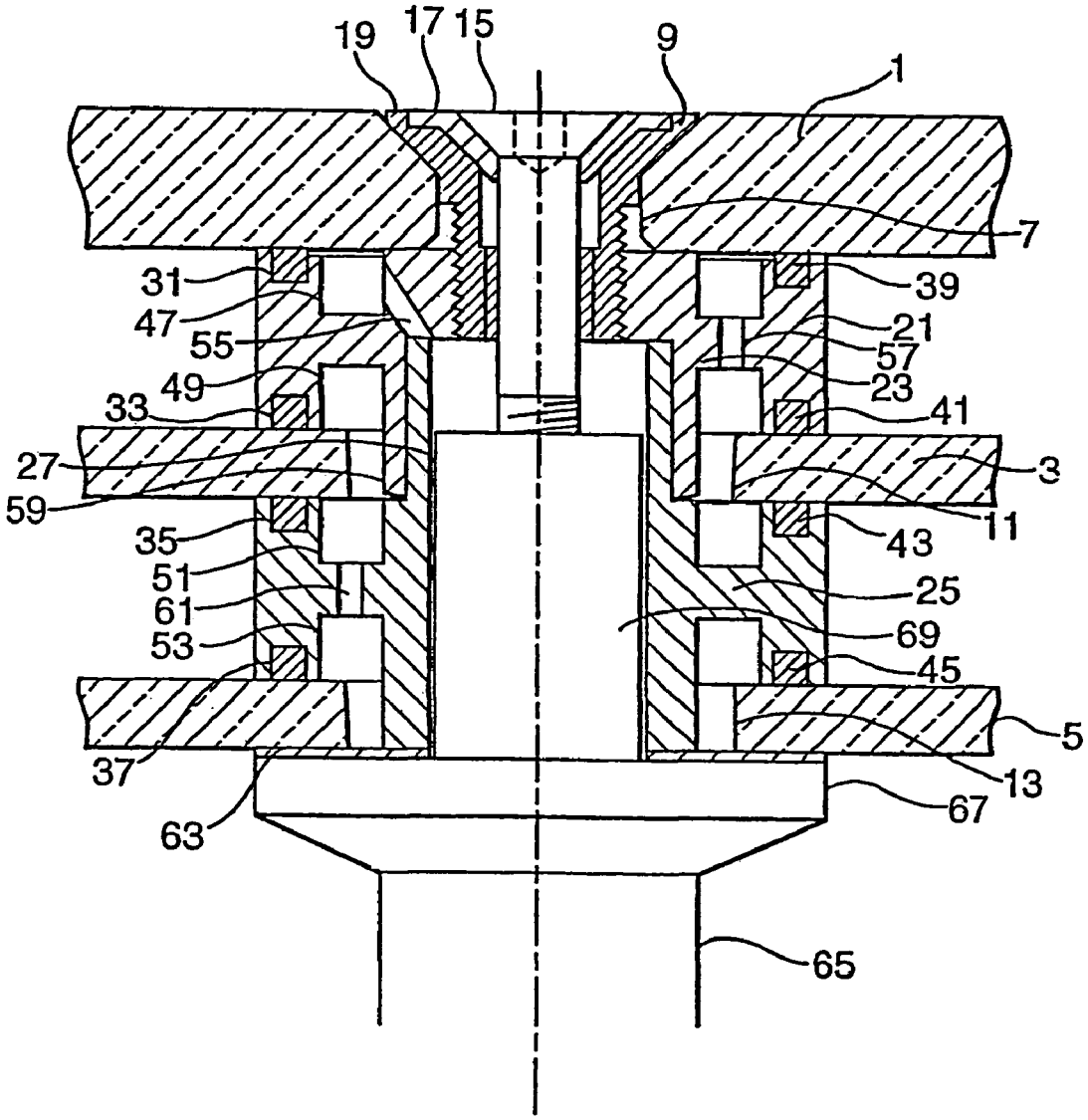
FIG. 1 is a part sectional view of a triple glazed unit according to the invention wherein the space between the outermost pane of glass and the centre pane of glass is hermetically sealed from the space between the centre pane of glass and the inner pane of glass and showing in detail a fixing assembly comprising a two part boss.

As shown in FIG. 1 the units comprise an outer pane 1, a centre pane 3 and an inner pane 5. Outer pane 1 has a hole 7 having a countersunk portion 9 adjacent to its outer face. Centre pane 3 has a circular hole 11 and inner pane 5 has a circular hole 13. Holes 7, 11 and 13 are aligned along a common axis. Fixing bolt 15 passes through holes 7, 11 and 13 and lies along their common axis. The countersunk head of fixing bolt 15 engages washer 17 and bush 19 in hole 7 and lies flush with the outer surface of outer pane 1.

Outer boss 21 is of generally cylindrical form. The upper surface of the outer boss 21 engages the inner face of the outer pane 1 and the lower surface of the outer boss 21 engages the upper surface of the centre pane 3. The upper part of the outer boss 21 engages bush 19. The lower portion of the outer boss comprises an extension 23 which passes through hole 11 and lies flush with the interior face thereof.

Inner boss 25 is also of generally cylindrical form. The upper surface of the inner boss 25 engages the lower surface of the centre pane 3 and the lower surface of the inner boss 25 engages the inner face of the inner pane 5. Inner boss 25 comprises an upper extension 27 which extends through hole 11 in the centre pane and is a snug fit with extension 23. The inner boss 25 also extends through hole 13 in the inner pane and lies flush with the outer face thereof.

The upper and lower surfaces of both the outer boss 21 and the inner boss 25 have annular grooves 31, 33, 35 and 37 machined into them. These grooves provide a seating for sealing O rings 39, 41, 43 and 45.

The upper and lower surfaces of both the outer boss 21 and the inner boss 25 have second annular grooves 47, 49, 51 and 53 machined into the surface thereof. These grooves accommodate a silicone sealant. Outer boss 21 has a bore 55 connecting groove 47 to the interior of the boss. At a point approximately diametrically opposite bore 55 a passage 57 connects grooves 47 and 49. Passage 59 between the extension 27 of the outer boss 21 and the edge of the centre pane 3 connects groove 49 with groove 51. Passage 61 connects grooves 51 and 53 at point approximately diametrically opposite passage 57. Bore 55, groove 47, passage 57, groove 49, passage 59, groove 51, passage 61 and groove 53 define a pathway through which silicone sealant can be injected into the glazing. The positioning of passage 61 diametrically opposite passage 57 ensures when the sealant is injected through bore 55 it enters groove 49 through passage 57 and then passes around both sides of the annular grooves 49 and 51 and the annular passage 59 before it can enter passage 61

Washer 63 fits on flanged spigot 67 and lies against the inner surface of the flange which provides a seat for washer 63. Nut 65 is tightened onto fixing bolt 15 to clamp the unit together. The fitting 69 extends into the interior of the boss to provide further support for the unit. The fitting is mounted onto the wall of a building using any of a variety of known fixings.

The units of this embodiment of the invention may be assembled using the following novel method. The outer pane 1 is fitted with bush 19 and the outer boss 21 is engaged with bush 19 and brought into contact with the interior face of outer pane 1. A spacer bar is then fitted around the perimeter of the pane 1. Centre pane 3 is then positioned upon extension 23 of the outer boss 21. The centre pane engages the spacer bar and is held loosely in place by adhesion to the primary butyl sealant present on that spacer bar. The inner boss 25 is then pushed into position such that extension 27 interlocks with extension 23 of the outer boss. A second spacer bar is then fitted around the perimeter of the centre pane. The inner pane 5 is then positioned on the inner boss 25 with its interior surface in contact with the lower surface of the boss. The inner pane 5 is held loosely in place by adhesion to the primary butyl sealant present on the spacer bar. The entire unit may then be compressed so as to bring the inner and outer portions of the boss 21 and 25 and the panes 1, 3 and 5 into closer alignment. Thereafter a suitable injector may be introduced into the interior of the boss and the secondary silicone sealant is injected into bore 55. The injection of sealant is continued until the sealant is seen to fill and emerge from hole 13. The unit may then be left to allow the secondary sealant to cure. Such units may be sold as articles of commerce and as such comprise a further aspect of this invention.

Figure 2:
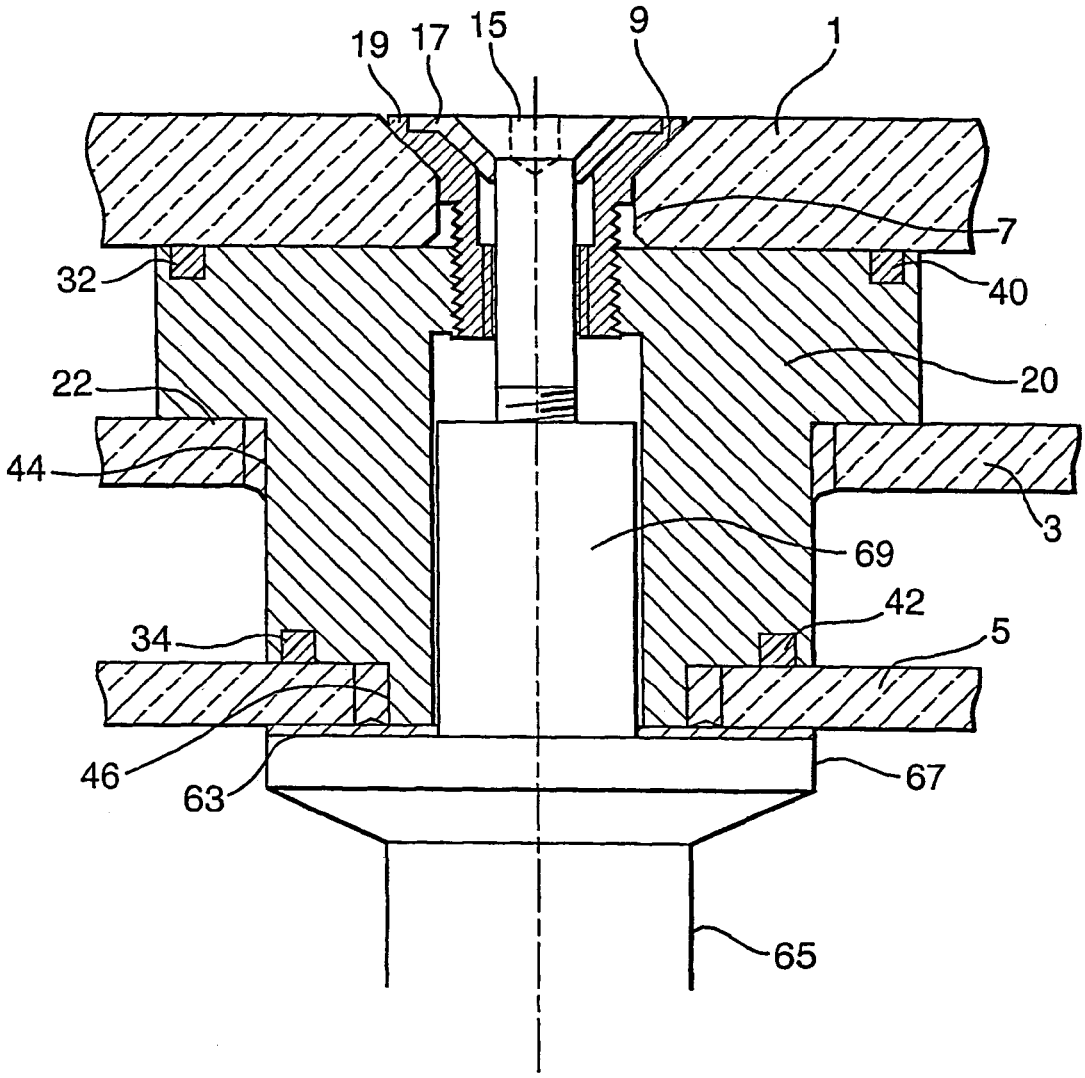
FIG. 2 is a part sectional view of a triple glazed unit according to the present invention utilising a tapered boss.

FIG. 2 shows a unit comprising an outer pane 1, a centre pane 3 and an inner pane 5. Fixing bolt 15 passes through holes 7,11 and 13 and lies along their common axis. The countersunk head of fixing bolt 15 engages washer 17 and bush 19 and lies flush with the outer surface of the outer pane 1.

Boss 20 is of generally cylindrical form. The upper surface of boss 20 engages the inner face of the outer pane 1. The lower surface of boss 20 engages the upper surface on inner pane 5. The boss 20 is tapered to provide a surface 22 which engages the outer face of the centre pane 3. The upper and lower surfaces of boss 20 have annular grooves 32 and 34 machined into them. These grooves provide a seating for sealing O rings 40 and 42. Silicone sealant is injected into annular gap 44 between the edge of centre pane 3 and boss 20 and also into the annular gap 46 between the edge of the inner pane 5 and boss 20.

Washer 63 sits on flanged spigot 67 and lies against the inner surface of the flange which provides a seat for washer 63. Nut 65 is tightened onto fixing bolt 15 to clamp the unit together. The fitting 69 extends into the interior of the boss to provide further support for the unit.

Figure 3:
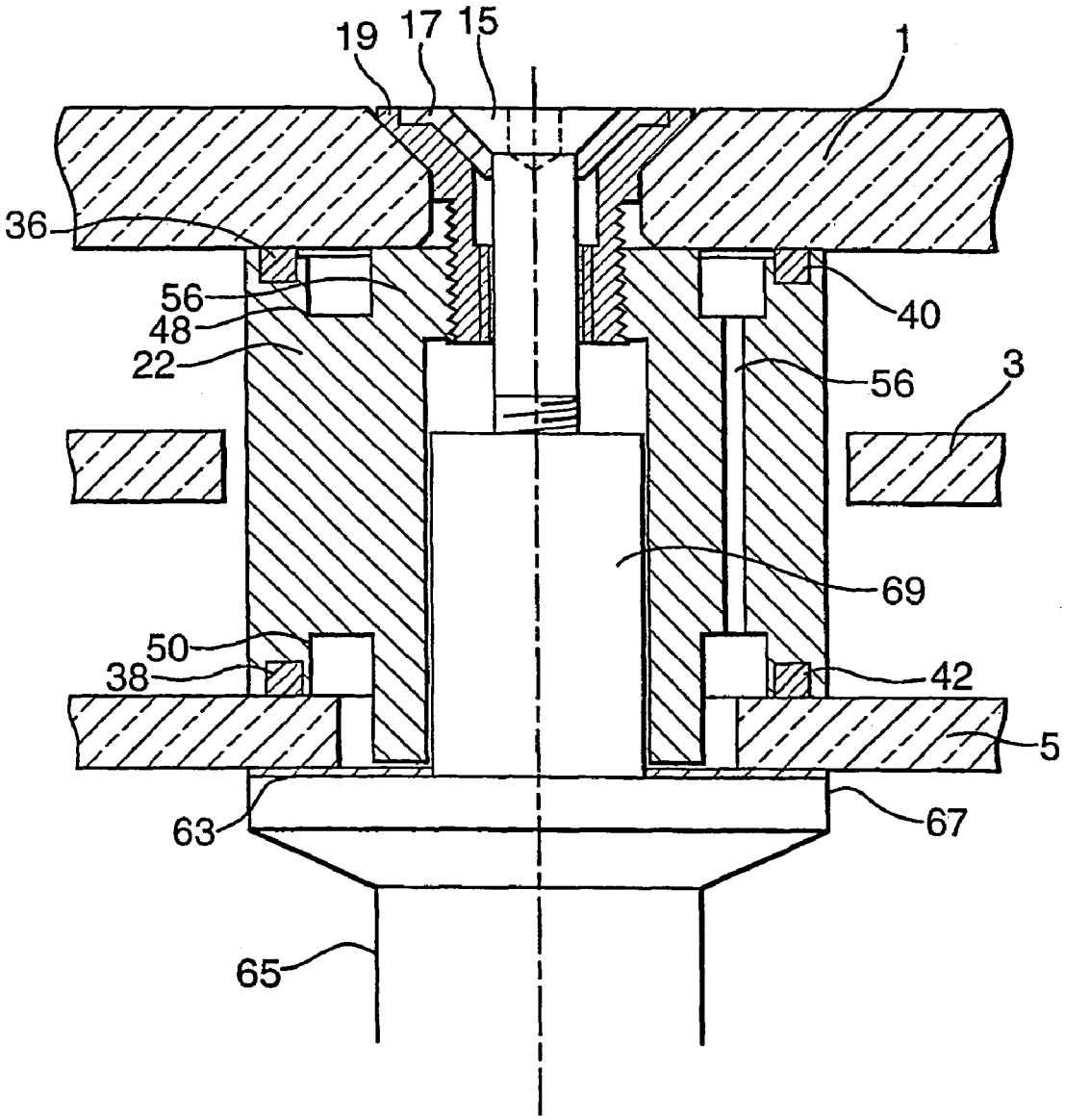
FIG. 3 is a part sectional view of a triple glazed unit according to the present invention utilising a cylindrical boss which is a close fit within a hole in the centre pane.

FIG. 3 shows a unit comprising an outer pane 1, a centre pane 3 and an inner pane 5. Fixing bolt 15 passes through holes 7, 11 and 13 and lies along their common axis. The countersunk head of fixing bolt 15 engages washer 17 and bush 19 and lies flush with the outer surface of the outer pane.

Boss 22 is of generally cylindrical form. The upper surface of boss 22 engages the inner face of the outer pane 1. The lower surface of the boss 22 engages with the upper surface of the inner pane 5. The upper and lower surfaces of boss 22 have annular grooves 36 and 38 machined into them. These grooves provide a seating for sealing O rings 40 and 42.

The upper and lower surfaces of boss 22 have second annular grooves 48 and 50 machined into them. Passage 56 connects grooves 48 and 50. Bore 56 connects groove 47 to the interior of the boss.

Centre pane 3 is held in position by the perimeter seals (not shown) between the outer pane 1 and the centre pane 3 and between the inner pane 5 and the centre pane 3. Centre pane 3 is a close fir around boss 22 so as to reduce the passage of air between the air spaces in the unit to an acceptable level.

Washer 63 sits on flanged spigot 67 and lies against the inner surface of the flange which provides a seat for washer 63. Nut 65 is tightened onto fixing bolt 15 to clamp the unit. The fitting 69 extends into the interior of the boss 22 to provide further support for the unit.

The units of FIGS. 2 and 3 may be assembled using processes analogous to those described in relation to FIG. 1.

These units may be transported to the building to which they are to be attached. At that point the fixing bolt is fitted through the boss to complete the fixing assembly and engaged with the locking nut so as to complete the fixing assembly. The unit is itself mounted upon the building.

The invention claimed is:

1. A frameless sealed multiple glazing unit which comprises at least three panes, an inner pane, a center pane and an outer pane, spaced apart from one another by perimeter seals and having at least one fixing position within the perimeter seals at which fixing position there is a fixing assembly which is attached to the inner and the outer panes and which passes through a hole in the center pane, wherein there is an air space between the inner pane and the center pane, and an air space between the outer pane and the center pane.

2. A unit according to claim 1 wherein said at least three panes are comprised of glass.

3. A unit according to claim 1 wherein the fixing assembly comprises a bush, a boss which is attached to the inner pane and to the outer pane and which passes through a sealed hole in the center pane and a fixing member which passes through the boss having a head which engages in a bush in the outer pane.

4. A unit according to claim 3 wherein the boss is in load bearing contact with the inner pane and with the outer pane.

5. A unit according to claim 3 wherein the boss is generally cylindrical in shape.

6. A unit according to claim 5 wherein those surfaces of the boss which are in contact with a surface of a pane comprise an annular groove and a resilient O ring primary seal located in said groove.

7. A unit according to claim 6 wherein those surfaces of the boss which are in contact with a surface of a pane further comprise a second annular groove which accommodates a secondary silicone sealant.

8. A unit according to claim 7 wherein a plurality of the second annular grooves are interconnected to form an interconnected passageway, and that the interconnected passageway comprises an inlet passage through which silicone sealant may be injected.

9. A unit according to claim 3 wherein the boss comprises two component parts which interlock to form the boss.

10. A unit according to claim 9 wherein a surface of a first component part of the boss is in contact with an inner surface of the outermost pane and the opposite surface of that part of the boss is in contact with the opposed surface of the center pane and a surface of the second component part of the boss is in contact with an inner face of the innermost pane and the opposite surface of that part of the boss is in contact with the opposed surface of the center pane.

11. A unit according to claim 10 wherein the first component part of the boss comprises a first hollow cylindrical extension which passes through the hole in the center pane.

12. A unit according to claim 11 wherein the second component part of the boss has a second hollow cylindrical extension which passes through the hole in the center pane and interlocks with the first hollow cylindrical extension.

13. A unit according to claim 12 wherein the external diameter of the second extension is substantially the same as the internal diameter of the first cylindrical extension.

14. A unit according to claim 13 wherein the second cylindrical extension is a push fit within the first cylindrical extension.

15. A method for the assembly of a unit according to claim 9 comprising the steps of:

(a) locating a bush into a countersunk hole in an outer pane;

(b) locating a first component part of the boss so that it is in contact with an interior surface of the outer pane;

(c) fitting a spacer bar around the perimeter of said outer pane;

(d) locating the center pane onto the first component part of the boss;

(e) locating a second component part of the boss so that it interlocks with the said first component part of the boss;

(f) fitting a spacer bar around the perimeter of said center pane;

(g) locating the inner pane so that it is in contact with the surface of the said second component part of the boss; and (h) compressing the unit.

16. A method according to claim 15 wherein the center pane is located upon an extension of the first component part of the boss and the second component part of the boss is located by engaging an extension thereof with the extension of the first component of the boss.

17. A method according to claim 15 further comprising an additional step (i) wherein a secondary silicone sealant is injected through an inlet passage into the spaces between the panes and the surfaces of the boss which are in contact with those panes.

18. A unit according to claim 9 wherein the second part of the boss comprises locating means which engages said first part of the boss and prevents the relative rotation of the two component parts of the boss about,their longitudinal axes.

19. A unit according to claim 3 wherein the boss is a tapered boss, one part thereof having a diameter greater than the diameter of the hole in the center pane and an adjacent part thereof having a diameter less than that of the hole in the center pane.

20. A unit according to claim 19 wherein said adjacent part of the boss is tapered, one part thereof having a diameter which is greater than the diameter of the hole in the inner pane and a second adjacent part thereof having a diameter which is less than the diameter of the said hole.

21. A unit according to claim 1, wherein said fixing assembly comprises a boss and a fixing member passing through said boss, wherein said boss is formed from two interlocking components.

22. A unit according to claim 21 wherein said two interlocking components have opposed faces which act upon the surfaces of the outer pane.

* * * * *